US009049916B2

(12) United States Patent
Berei

(10) Patent No.: US 9,049,916 B2
(45) Date of Patent: Jun. 9, 2015

(54) BACKPACK FOR CARRYING A FOLDED FOLDING CHAIR AND METHOD

(71) Applicant: Stephen Berei, Zephyr Cove, NV (US)

(72) Inventor: Stephen Berei, Zephyr Cove, NV (US)

( * ) Notice: Subject to any disclaimer, the term of this patent is extended or adjusted under 35 U.S.C. 154(b) by 0 days.

(21) Appl. No.: 14/533,020

(22) Filed: Nov. 4, 2014

(65) Prior Publication Data

US 2015/0122860 A1 May 7, 2015

Related U.S. Application Data

(60) Provisional application No. 61/899,813, filed on Nov. 4, 2013.

(51) Int. Cl.

| | |
|---|---|
| ***A45F 3/04*** | (2006.01) |
| ***A45F 3/00*** | (2006.01) |
| ***A47C 4/28*** | (2006.01) |

(52) U.S. Cl.

CPC ... *A45F 3/00* (2013.01); *A47C 4/28* (2013.01); *A45F 2003/003* (2013.01); *A45F 3/04* (2013.01)

(58) Field of Classification Search

CPC ..... A45F 3/04
USPC ..... 224/581, 576, 153, 657, 650, 651
See application file for complete search history.

(56) References Cited

U.S. PATENT DOCUMENTS

| | | | | |
|---|---|---|---|---|
| 4,972,981 | A * | 11/1990 | Gex | 224/645 |
| 5,323,943 | A * | 6/1994 | Elledge | 224/265 |
| 5,570,829 | A | 11/1996 | Harrison | |
| 5,676,296 | A * | 10/1997 | Masters | 224/653 |
| 5,779,112 | A * | 7/1998 | Krulik | 224/155 |
| 5,810,223 | A * | 9/1998 | Helm | 224/250 |
| 5,893,504 | A * | 4/1999 | Baronian et al. | 224/656 |
| 6,536,638 | B1 * | 3/2003 | Gulmatico, III | 224/153 |
| 6,712,250 | B2 * | 3/2004 | Vigny | 224/640 |
| 2007/0062995 | A1 | 3/2007 | Kasuli et al. | |
| 2008/0078789 | A1 * | 4/2008 | Fiola | 224/155 |
| 2013/0105530 | A1 * | 5/2013 | Davis, Jr. | 224/257 |
| 2014/0305822 | A1 * | 10/2014 | Kienel et al. | 206/315.1 |

* cited by examiner

*Primary Examiner* — Justin Larson
(74) *Attorney, Agent, or Firm* — Long & Chybik; John D. Long, Esq.

(57) ABSTRACT

One possible embodiment of the invention could be a backpack for carrying folding chairs comprising a front panel, the front panel supporting at least one shoulder strap that is used to connect the backpack to an operator; a back panel; the back panel being connected to the front panel by a mutual bottom edge; one or more connection straps that can respectively removably further attach a front panel to a back panel; wherein when the backpack is carrying a folded folding chair that extends outwards past the front and back panels, the connection straps engage the folded folding chair to sandwich and otherwise hold the folded folding chair between the front panel and the back panel.

20 Claims, 8 Drawing Sheets

BACKPACK FOR CARRYING A FOLDED FOLDING CHAIR AND METHOD

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention may relate to backpacks for carrying at least one folded folding chair. More particularity to those backpacks that may partially encapsulate the folded folding chair so being carried.

BACKGROUND

Excursions to the beach, concerts, light hiking, picnics, sporting events and the like generally have one or more of excursion participants carrying objects that may be used at the desired destination. These objects may include containers of food and drink; dishes and other eating/cooking utensils; blankets, beach umbrellas; beach towels, clothing and the like which are substantially small enough to be packed into and be transported by one or more handled bags, backpacks, wheeled carriers and the like. However, there are larger objects (e.g., tables, umbrellas, folding chairs and the like) that may pose a greater problem in their transport in that they may be considered bulky, cumbersome and somewhat unwieldable for hand-carried transport. The hand-carrying of a folding chair (e.g., lawn chairs, captain's chairs, and the like) that generally have to be accomplished by either hoisting the chair into one's arms or by holding onto the chair by its frame. Due to the folding chair's bulk, the person carrying the folded folding chair may be prevented from carrying other things. Further, if such a person is traveling with small children, the hand-carrying of folded folding chairs may further interfere with the usual process of holding onto the children by the hand as a way of the keeping the children safe and close at hand during the travel.

Another means of carrying the folded folding chair (e.g., generally hands-free) may include simply hanging the chair from or strapping the chair to the person's body. This body-based chair carrying means may be uncomfortable and/or feel unbalanced on the person's body. Further, the folding chair construction in itself may not lend the chair to be easily secured to a person's body.

One possible solution to this folding chair carrying issue could be the present invention, which may allow the carrying of a folded folding chair through the use of a backpack strapped to the person. The backpack could hold one or more folded folding chairs to otherwise free the arms of the backpack wearer for other tasks. Such a backpack could be a soft-sided and further have at least two sides, a front panel and a back panel generally being flexibly connected each other at a respective bottom to support a folded folding chair(s) as placed between the front panel and back panel. The front panel could further comprise of one or more adjustable shoulder straps to generally allow the removable attachment of the backpack to an individual while the back panel could have multiple storage compartments (both insulated and non-insulated.) The invention could further comprise of one or more adjustable connection straps that could connect the front and back panels to one another in a generally parallel orientation to substantially sandwich a folded folding chair between the two panels. If the dimensions of the folded folding chair being carried by the backpack should exceed the dimensions of the backpack's panels so that the one or more edges of the folded folding chair extends out beyond the one of more edges of the backpack (e.g., top and side edges of the front and back panels), then the connections straps can be appropriately employed to go around the folded folding chair edges (e.g., sides and top chair edges) to further secure the folded folding chair to the backpack.

SUMMARY OF ONE EMBODIMENT OF THE INVENTION

Advantages of One or More Embodiments of the Present Invention

The various embodiments of the present invention may, but do not necessarily, achieve one or more of the following advantages:

to provide a backpack than can carry one or more folded folding chairs as well as other items;

the ability to use a backpack to carry one or more folding chairs whose dimensions otherwise prevent the folded folding chair that is being carried by the backpack from being fully enclosed within the backpack;

to provide a backpack that could carry folded folding chairs of different dimensions;

the ability to generally carry folded folding chairs and other items that are required to be kept either hot or cool;

to provide a folded folding chair carrying backpack that substantially has a thermal insulating capability;

to provide a backpack that could further carry a compacted chair on its exterior surface;

to provide a backpack that could carry a folded folding chair sandwiched in between a front panel and a back panel, the two panels sharing a common bottom edge upon which the folded folding chair can rest;

the ability to link a front panel and back panel of backpack by containment straps to sandwich a folded folding chair between the front and back panels; and to provide a backpack capable of carrying one or more folded folding chairs in between a front panel and a back panel of the backpack that are connected together by adjustable length straps to accommodate folded folding chairs whose edges may extend past one or more edges of the panels;

to provide a backpack capable of carrying one or more folded folding chairs in between a front panel and a back panel of the backpack that are connected together by a common bottom edge and a set of connection straps, the straps going around those edges of the folded folding chair that protrude outward beyond the edges of the front and back panels; and to provide a backpack to carry a folded folding chair in between a front panel and a back panel of the backpack, the backpack further supporting a detachable insulated bag.

These and other advantages may be realized by reference to the remaining portions of the specification, claims, and abstract.

Brief Description of One Embodiment of the Present Invention

One possible embodiment of the invention could be a backpack for carrying a folding chair comprising: a front panel, the front panel supporting at least one shoulder strap that is used to removably connect the backpack to an operator; a back panel; the back panel being connected to the front panel by a mutual bottom edge; a set of connection straps comprising of a first connection strap that removably connects a front panel top edge to the back panel, a second connection strap that that removably connects a front panel first side edge to the back panel, and a third connection strap that that removably connects a front panel second side edge to a back panel; wherein when a folded folding chair is placed between the front panel and back panel, the set of connection straps can further engage the folded folding chair in a manner to removably attach the folded folding chair to the backpack by holding the folded folding chair between the front panel and back panel.

Another possible embodiment of the invention could be A backpack for carrying folding chairs in combination with a folded folding chair comprising a backpack having a front panel that connects to a back panel by a common edge, the front panel supporting at least one shoulder strap that is used to connect the backpack to an operator; the front panel further additionally reversibly attaches to the back panel by a plurality of connection straps; a folding chair that moves from an unfolded position that allows a person to sit in the folding chair to a folded position for storage, the folding chair being in the folded position; wherein the folded folding chair is placed between the front panel and back panel to be sandwiched between the front panel and back panel so that one or more edges of folding chair that protrude outward from between the two panels, a set of connection straps removably connects the folding chair to the backpack between front panel and back panel.

A process for operating backpack that is used to carry a folded folding chair, the process comprising the following steps, providing a folding chair that moves from an unfolded position that allows a person to sit in the folding chair to a folded position for compact storage, the folding chair being in the folded position; providing a backpack having a front panel that hingedly connects by a common edge to a back panel, the front panel further supporting at least one shoulder strap that is used to connect the backpack to an operator; the front panel further removably attaches to the back panel by a plurality of connection straps; placing the folded folding chair between the front panel and the back panel so that the folded folding chair rests upon the common edge to be sandwiched between the front and back panels, one or more portions of the folded folding chair extending past one or more of the edges of the front panels; and engaging the set of connection straps to hold the folded folding chair between the front panel and the back panel.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
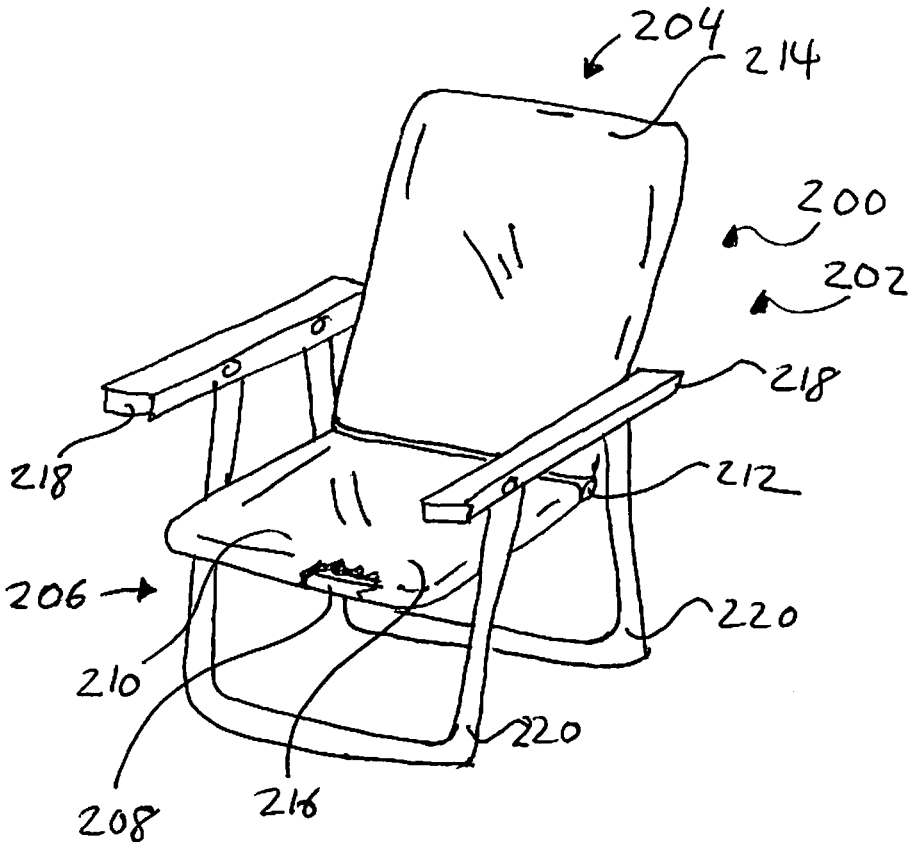
FIG. 1 is substantially a perspective cutaway view of one embodiment of a folding chair in the operating condition.
Figure 2:
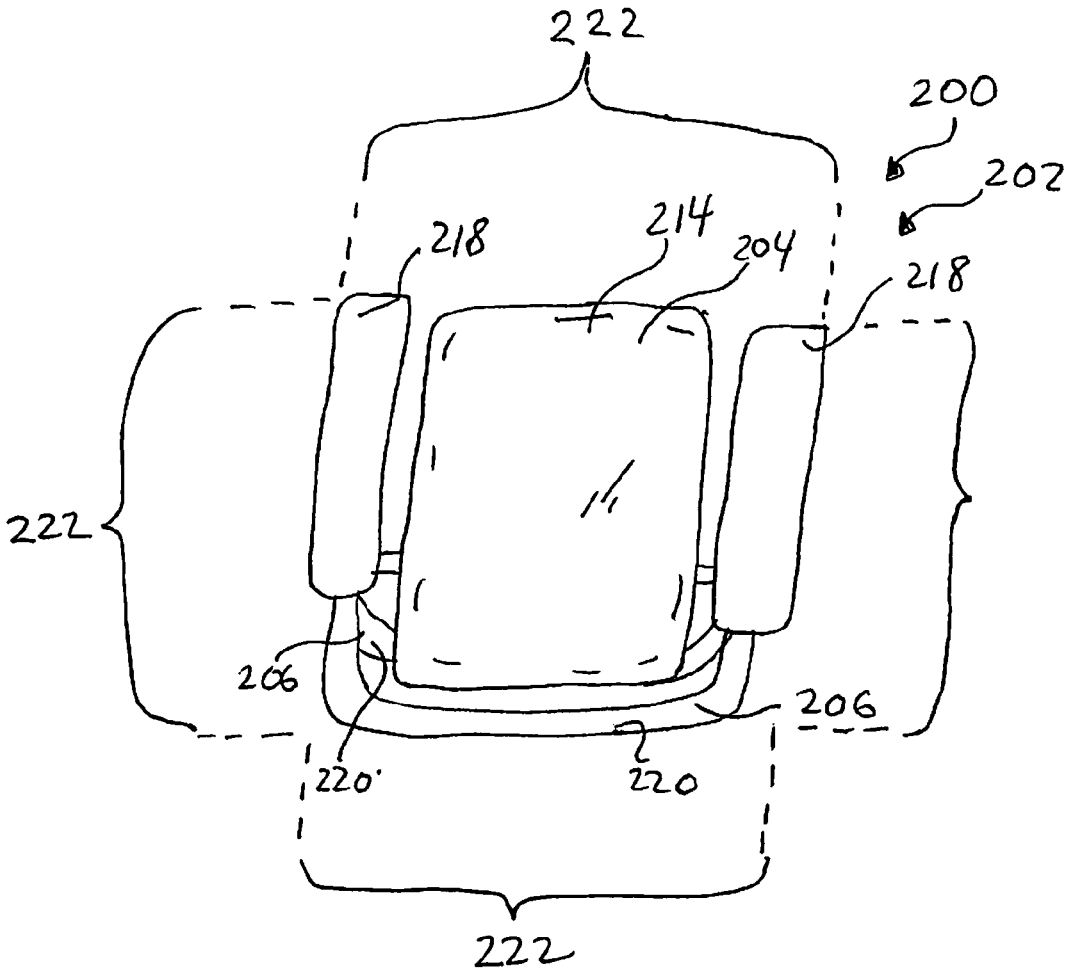
FIG. 2 is substantially a perspective elevation view of one embodiment of a folding chair in the folded position.

The present invention 10 could comprise of a backpack 20 for carrying one or more folded folding chairs and a method or process for operating said backpack 20. While there are many different types of folding chairs 200, one illustrative type of folding chair that may commonly encountered picnicking or going to the beach could be a first folding lawn chair 202 as substantially shown in FIGS. 1 and 2. The first folding lawn chair 202 could comprised of a seat section 204 used to support the seated person and that is further held up and away from the ground by a support section 206. The seat section 204 could be defined by two U-shaped seat frames 208 hingedly attached by their ends to a rod 212 wherein fabric attached to the seat frames 208 to form back rest 214 and seat rest 216. The support section 204 could have a pair of handles 218 that are pivotally attached to the ends of a pair of U-shaped support frames 220. The support frames 220 could also be pivotally attached to the seat frames 208 to hold the seat section 204 between the arms of support frames 220.

Utilizing this configuration, the lawn chair 200 can move between a first collapsed, compact position for storage and/or transport to a second open, operating condition that allows a person to sit in or upon the lawn chair 202. When moved into the second or collapsed/storage position, the seat rest 216 and back rest 214 are brought together in a generally parallel configuration while the ground contacting portions of the support frames 220 are generally brought together as well and substantially moved against the seat section 204. In this manner, the folding chair 200 has a somewhat planar and square presentation denoted by its four side edges 222.

In the second operating condition, the back rest 214 and seat rest 216 can be pulled open and apart relative to one another to generally place the back rest 214 and the seat rest 216 in obtuse orientation to one another to allow the seat rest 216 to hold the person (not shown) while the back rest 214 allows the person (not shown) to lean back into the lawn chair 200. The ground contacting portions of the support frames 220 are move apart from one another to provide a stable platform to hold the seat section 204 up and away from the ground.

Figure 3:
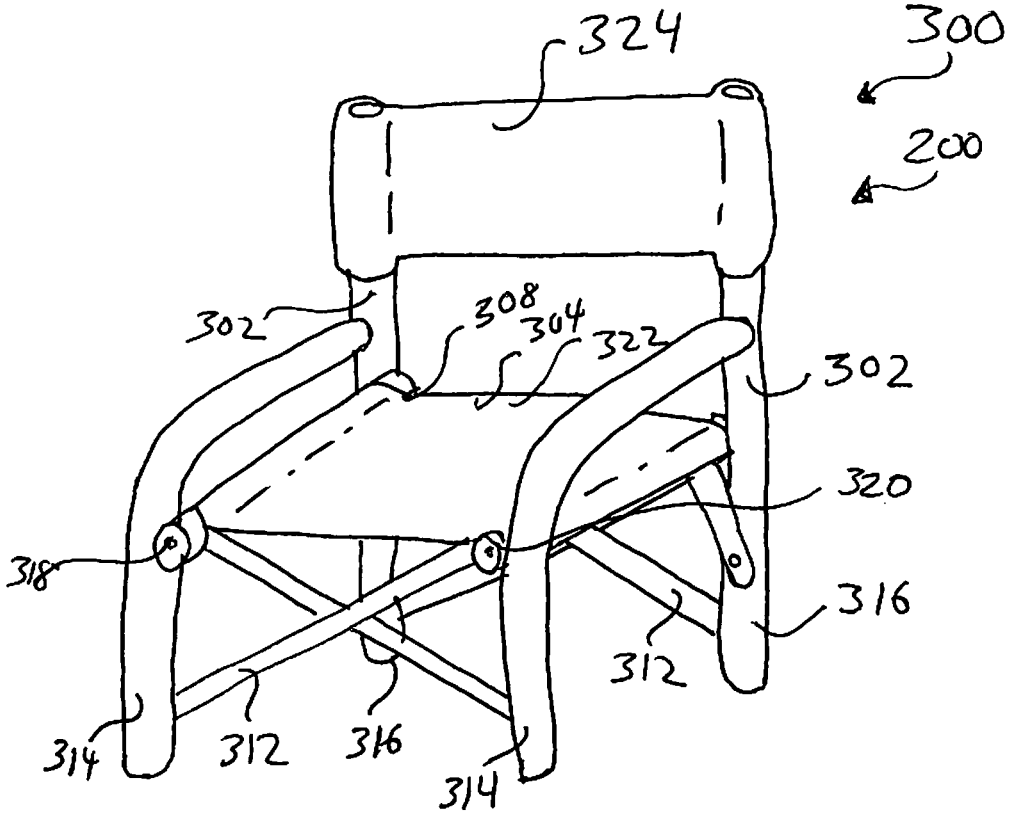
FIG. 3 is substantially a perspective front view of another embodiment of a folding chair in the operating condition.
Figure 4:
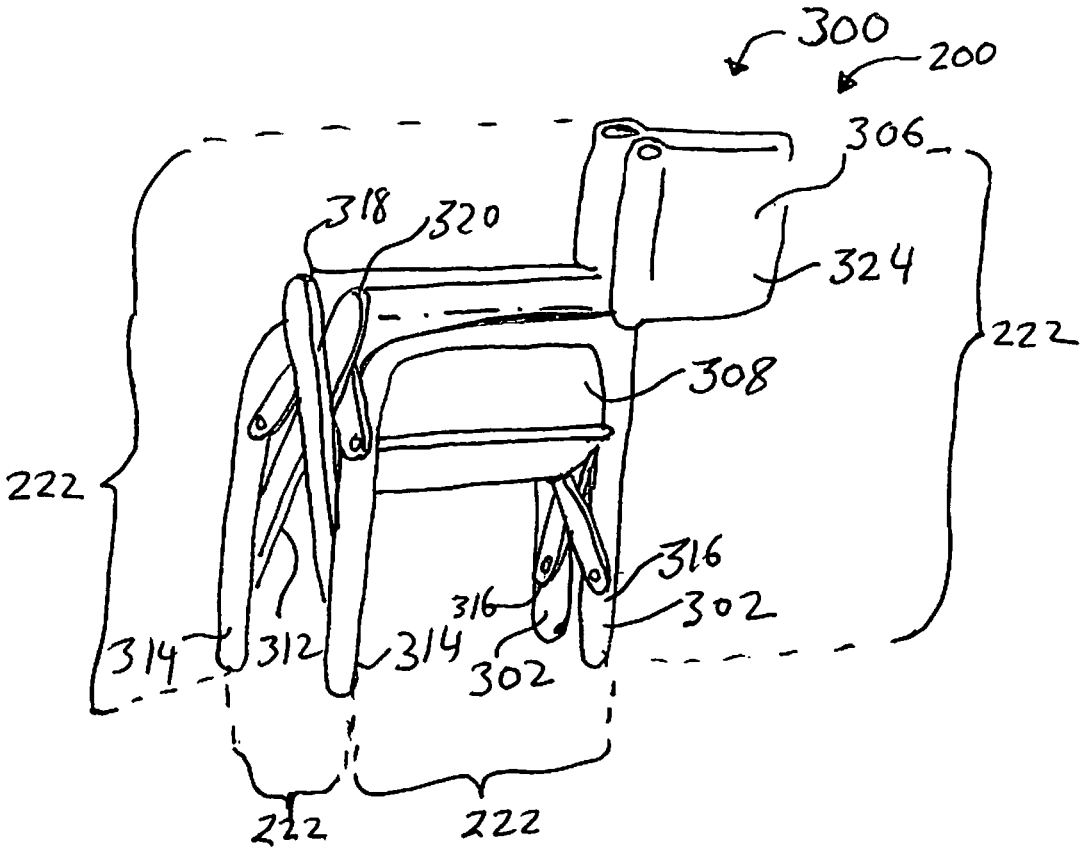
FIG. 4 is substantially a perspective front view of another embodiment of a folding chair in the folded position.

As substantially shown in FIGS. 3 and 4, yet another kind of folding chair 200 that can be carried by the invention 10 could a second lawn chair 300 having h-shaped side frames 302 The legs of the h-shaped side frames 302 could act as a support portion 310 that generally holds a seat portion 310 up and away from the supporting ground. One scissors-type bracing 312 could connect a front pair of legs 314 of the h-shaped frames 302 to each other while another scissors-type bracing 312 could be used to connect a back pair of legs 316 of the h-shaped frames 302 to each other. The top left ends of the scissors-type bracing pairs 312 could be connected by a first seat bar 318 while the top right ends of the scissors-type bracing pairs could be connected by second seat bar 320. A fabric seat 322 connecting the two seat bars, 313, 315 together could form the seat portion 310 while a fabric back rest 324 connecting the h-shaped frames together could form a back rest portion 306.

The scissors-type bracing 312 in their extended position could hold the h-shaped frames 302 and seat bars 313, 315 apart to open up the back rest and seat portions 306, 308 to support an operator (not shown.) The scissors-type bracing 312 in their collapsed position could allow the h-shaped frames 302, and seat bars 313, 315 to be brought proximate in a parallel configuration to each other to place the second lawn chair 300 into a generally planar state for storage and/or transport, the collapsed configuration also having several side edges 222.

The types of folding chairs 200 described-above and otherwise illustrated are merely demonstrative of the wide variety of types, shapes and sizes of folding chairs 200 that can be carried by the backpack 20 without otherwise limiting the breath of the invention 10.

Figure 5:
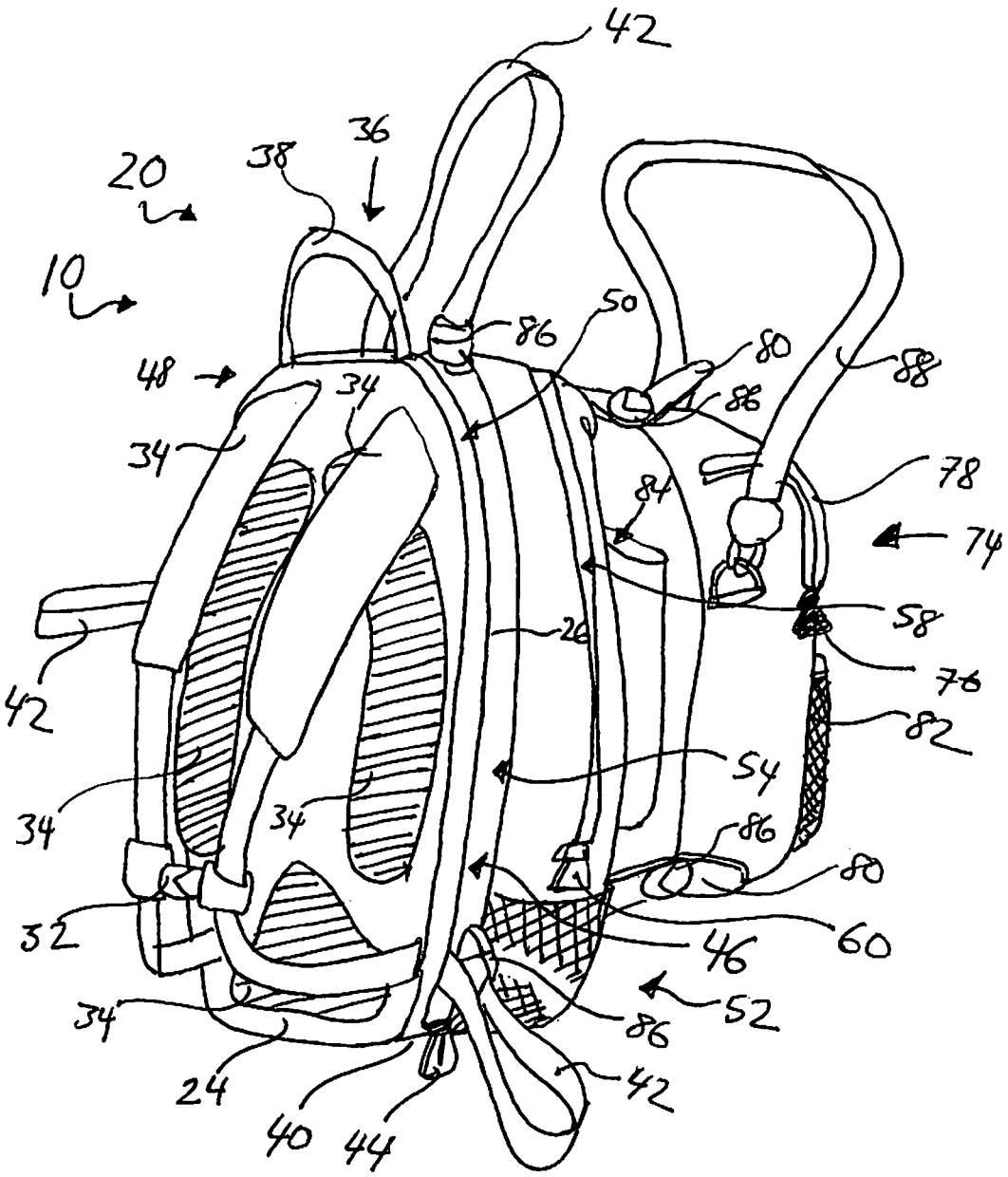
FIG. 5 is substantially a perspective front view of one embodiment of the backpack of the present invention.
Figure 6:
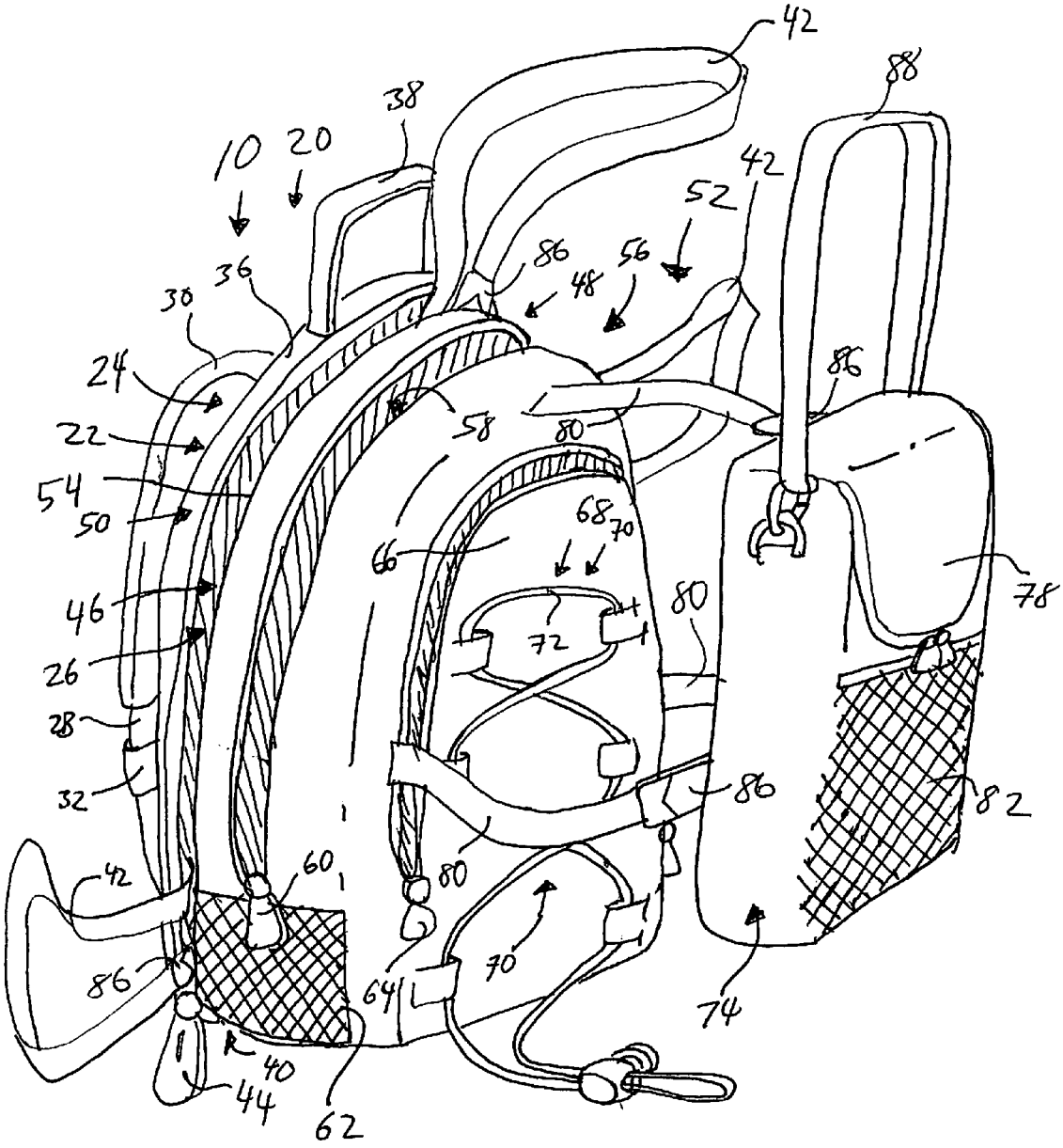
FIG. 6 is substantially a perspective rear view of one embodiment of the backpack of the present invention.
Figure 7:
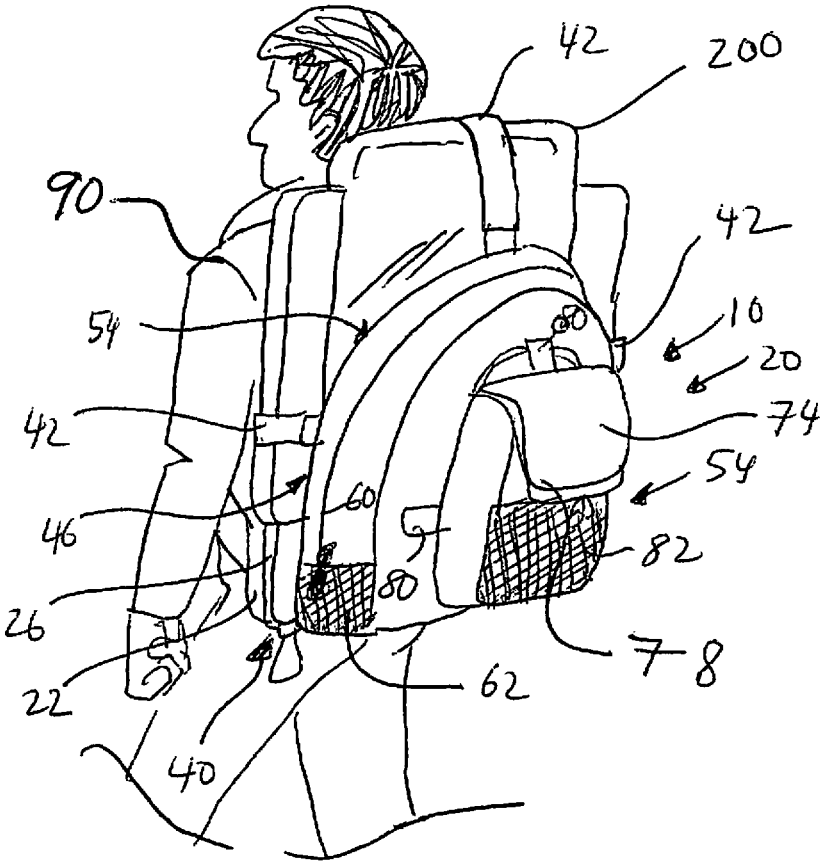
FIG. 7 is substantially a perspective view of one embodiment of the present invention's backpack being worn by an operator, the backpack carrying a folded folding chair.

As substantially shown in FIGS. 5, 6 and 7, the backpack 20 could be comprised of a flexible or soft side front panel 22 and a flexible back panel 52 connected together by a common bottom edge 40. The front panel 22 could have a front side 24 and a back side 26. The front side 24 could feature one or more shoulder straps 28 that could be used to removably connect the backpack 22 to an operator 90. The shoulder strap 28 could be adjustable in length and further feature a padded strap portion 30 to reduce fatigue of the shoulder of the operator 90 (FIG. 7) during use to which the shoulder strap 28 may be applied. If a pair of shoulder straps 28 are used, an adjustable clip strap 32 could be used mid-strap to connect the two shoulder straps 28 together to further hold the backpack 20 in place upon the operator 90. The front side 24 could additionally further feature one or more padded areas 34 for supporting shoulder and small of the back portions of the backpack 22 as located upon the operator's back and further reduce back operator's fatigue during usage. At the top edge 36 of the front panel 22 could be a handle 38 for carrying the backpack (e.g., with the folded folding chair 200) by the operator without having using the shoulder straps 28.

The front panel's back side 26 could feature a set of connection straps 42 wherein each edge of the front panel (e.g., top edge 36, right edge 48 and, left edge 50) could have a single respective connection strap 42 that could removably attach to the front panel 22 to the back panel 52. Each of the connection straps 42 could respectively removably attach to the back panel 52 by a clip connector 86 that could further allow for the length adjustment of the respective connection strap 42. The overall length of the connection strap 42 could be suitably adjusted to generally allow the invention 10 to accommodate a wide variety of folded folding chairs 200 whose outside dimensions (e.g., width and/or height) that could exceed those outside dimensions of the front and back panels 22, 52. The length of the connection strap 42 could be suitably adjusted to allow the connection strap 42 to suitably engage the folded folding chair 200 (e.g., the connection straps 42 could go around a respective outside edge 222 of the folded folding chair 200 as placed between the front and back panels 22, 52 when resting upon the common bottom edge 40) in a manner to restrain or suitably hold the folded folding chair 200 between the front and back panels 22, 52.

A zipper 44 could respectively removably (or reversibly) seal the two front panel 22 and back panel 52 together to denote or otherwise form a chair compartment 46 that could otherwise enclose the connection straps 42 when the backpack 20 is not carrying a folded folding chair 200 or is carrying a folded folding chair 200 whose outside dimensions or parameters (e.g., outside edge 222) generally allow the folded folding chair 200 to fit within and be enclosed by the chair compartment 46.

The back panel 52 could have a front portion 54 forming a part of the chair compartment 46 and a back portion 56 that could form a back portion carrying compartment 58 that is accessed by a back panel ripper 60 found along the two sides and top of the back panel 52. The back panel carry compartment 58 could be used to store and carry non-chair articles (e.g., food, beach toys, towels etc.) The back portion zipper 60 does not go all the way down to the bottoms of the back panel sides in that open-top mesh panel pockets 62 with elastically contracted open-tops generally occupy those areas. These open-top mesh panel pockets 62 can be used to carry wet articles (e.g., bathing suit and the like) that are desirable to be air dried and allow water/moisture to pass through the mesh pockets 62. The back portion 56 could have a second back portion zipper 64 that denotes and removably seals an inverted U-shaped flap 66 that could allow a second means of access to the back portion carrying compartment 58. The inverted U-shaped flap 66 does not reach to the bottom of the back portion 56 but only proceeds down approximately two-thirds of each side of the back portion 56.

The inverted U-shaped flap 66 and a part of the back portion 56 below the inverted U-shaped flap 66 could further support a criss-cross bungee holding system 68 having an openings 70 at both top and bottom to allow criss-cross bungee holding system 68 to accept (through the top or bottom) and hold large and/or bulky objects (not shown) like a lawn blanket. A portion of the elastic cord 72 (i.e., the bungee) found at the bottom of the system 68 could folded together to form a closed loop end and be feed into and through a clamp 74, the clamp 74 generally acting as a cinch to reduce the amount of available useable elastic cord 72 to tighten down upon an object being held by the system 68.

In one embodiment, the invention 10 could further comprise of a flexible insulated bag 74 that could keep food and/or beverages cool or warm as needed or desired. A bag zipper 76 located upon the insulated bag top could denote and removably seal a U-shaped bag flap 78 that removably seals the insulated bag 74 and allows access to the bag's interior (not shown.) Below U-shaped bag flap 78 could be an open-topped mesh back pocket 82. On the side of the insulated bag 74 facing the back portion 56 could be located open-topped solid pocket 84.

A set of adjustable bag straps 80 could removably secure the insulated bag 74 to the back portion 56. A bag strap 80 could be respectively anchored to each of the edges (e.g., left side, top and right side) of the insulated bag 74. These bag straps 80 could be removably attached to the back portion by clip connectors 86. The clip connectors 86 can be further used to adjust the length of the bag straps 80 to increase or decrease the distance between the back portion 56 and the insulated bag 74 (e.g., to compensate for the amount of space taken up by the object(s) being held by the criss-cross bungee holding system 68.) A carrying strap 88 could be clipped to the sides of the insulated bag 74 to allow the insulated bag 74 to be carried separately from the remainder of the backpack 20.

Figure 8:
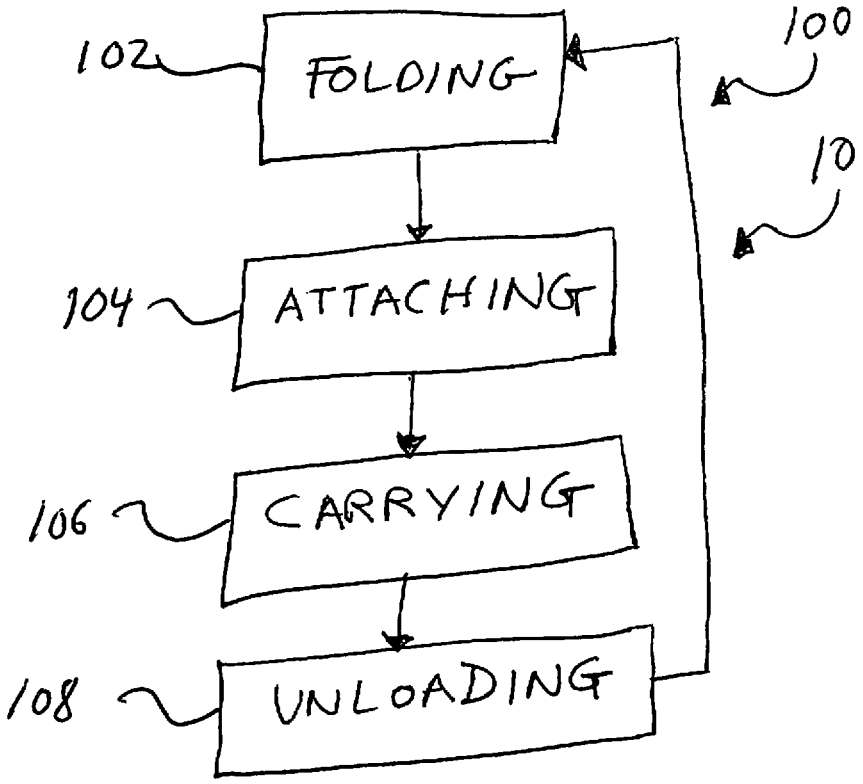
FIG. 8 is substantially a flow chart of one embodiment of the process for using the backpack to carry a folded folding chair.

As substantially shown in FIG. 8, one possible method, process or procedure 100 for operating the invention to carry a folded folding chair could start with step 102 folding the chair. In this step, the operator could select the folding chair that the operator wishes to carry using the invention. The operator, utilizing folding protocols required by the particular folding chair, folds or otherwise compacts the folding chair into its storage position. Using rough estimate and understanding of the folded folding chairs outside edge dimensions, the operator can determine if the height or width of the folded folding chair exceeds those dimensions of the front/back panels of the invention. At the substantial completion of this step 102, the process 100 could continue to step 104, attaching the folded folding chair to the backpack.

In step 104, attaching the folded folding chair to the backpack, the operator could unzip and separate the front panel from the back panel. In the folded folding chair height and/or width dimensions are the same or smaller that those of the front/back panels, then the connection straps need not be used and the folded folding chair can be placed upon the common edge and front and back panels can be used to sandwich the folded folding chair between them. The zipper can be used to seal the folded folding chair within the compartment formed by the front and back panels.

If the folded folding chair's dimensions (when placed in the storage position) exceed either the height or width of the panels, the supporting straps can be used to retain the folded folding chair(s) between the panels. If the folded folding chair only exceeds the height of the panels, then the top connection strap could be used. The zipper for the panels could be a double zipper so that each zipper could respectively zip up a set of sides of the two panels, leaving the folded folding chair to protrude out the open top of the compartment (further secured with or without the top connection strap). In one instance, the top connection strap could go around and over the top of the folded folding chair to snug the chair within and to invention. If so desired, the side connection straps could also be used to go around the sides of the chair to further secure the chair as being held by the zipped up sides.

If the folded folding chair exceeds both the width and height of the front panels, then all the connection straps may be used to go around the top and sides of the folded folding chair as the chair protrudes from the side(s) and top of the two panels. The connectors may be used to adjust the length of the attachment straps to snuggly hold the folded folding chair within the straps.

Once at least one folded folding chair (in at least one embodiment of the invention, a plurality of folded folding chairs could be attached to the invention between the front panel and back panel) is appropriately secured to the backpack, the other compartments, pockets, and carrying system may be filled with objects to be carried along with the chair. The process 100 may proceed to step 106, carrying the combination of backpack and folded folding chair In step 106, carrying the combination of backpack and folded folding chair, the operator, if tall enough to allow the bottom of the backpack clear the ground, could grasp the grip handle to pick up and carry the chair-backpack combination along the operator's side. Otherwise, the operator could lift up and swing the combination around to the operators back in a manner to place one arm through a shoulder strap. As the combination is then placed upon the operators back, the second arm could be placed through the remaining shoulder strap. The adjustable clip strap could connect the two shoulder straps across the operator's chest to securely and firmly locate the combination upon the operator. Once the operator has reached the desired destination, the process could proceed to step 108, unloading the backpack.

At step 108, unloading the backpack, the operator can disengage the adjustable clip strap (if so used) and dismount the combination from the operator's back generally performing the reverse of the above stated loading procedure. The combination could be placed upon suitable support (e.g., ground, table, and the like) to allow the operator to unsnap or disconnect the connection straps/un zip zippers and the like. In this manner, the folded chair whose folded dimensions allow it to fit within the chair compartment can be released from the backpack by suitably unzipping the zipper for that compartment. For the folded chair whose folded dimensions do not allow it to fit within the chair compartment, then unsnapping/releasing the connection straps (and if necessary unzipping the zipper) can release the folded folding chair from being located between the front panel and back panel of the backpack. Other items can be removed from the pockets, compartments and systems as needed. If the invention is desired to move folding chair to another location, the process 100 could return to step 102.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

As generally shown above and substantially illustrated by the figures, the present invention is a backpack used to carry or tote folded folding chairs and a method, process, or procedure to use the backpack in such a manner. If the chair in its folded state is generally too large to be carried within a sealed compartment of the backpack, the backpack constructed of front and back panels connected by a common bottom edge allows at least a portion of the outsized folded folding chair to be sandwiched between the two panels. Straps further connecting the two panels together can be used to secure the outsized folded folding chair between the panels for transport by an operator.

What is claimed is:

1. A backpack for carrying a folding chair comprising:

(A) a front panel, the front panel supporting at least one shoulder strap that is used to removably connect the backpack to an operator;

(B) a back panel; the back panel being connected to the front panel by a mutual bottom edge and a first fastener to form a chair compartment;

(C) a set of connection straps comprising of a first connection strap that removably connects a front panel top edge to the back panel, a second connection strap that that removably connects a front panel first side edge to the back panel, and a third connection strap that that removably connects a front panel second side edge to a back panel;

wherein when the first fastener is closed, the chair compartment encloses the set of connection straps; and wherein when a folded folding chair is placed between the front panel and back panel, the set of connection straps can further engage the folded folding chair in a manner to removably attach the folded folding chair to the backpack by holding the folded folding chair between the front panel and back panel.

2. The backpack of claim 1 wherein the connection straps are adjustable in length to accommodate and secure to folded folding chairs of various dimensions to the backpack.

3. The backpack of claim 2 wherein one or more side edges of the folded folding chair prevent the chair from being fully encapsulated between the front panel and rear panel by said first fastener.

4. The backpack of claim 2 wherein one or more side edges of the folded folding chair extend past the front panel and rear panel.

5. The backpack of claim 1 wherein the first fastener is a zipper.

6. The backpack of claim 5 wherein the back panel further forms a second enclosure separate from the chair compartment that is accessible by a second zipper, the second zipper being different from the first zipper, the ends of the second zipper terminate in open-top mesh pockets.

7. The backpack of claim 6 wherein the second enclosure is further accessible by a third zipper that is separate from both the first and second zippers.

8. The backpack of claim 7 wherein the third zipper further denotes a flap having a crisscross bungee system for holding an object.

9. The backpack of claim 1 further comprising an insulated cooler that is reversibly attaches to the back panel by a set of attachment straps.

10. The backpack of claim 1 further comprising a grip handle at the top of the backpack, the grip handle being separate from the at least one shoulder strap, the grip handle being grasped by an operator to carry the backpack by hand when the folded folding chair is attached to the backpack by being sandwiched between the front panel and hack panel.

11. A backpack for carrying folding chairs in combination with a folded folding chair comprising:

(A) a backpack having a front panel that connects to a back panel by a common edge and a first fastener to form a chair compartment, the front panel supporting at least one shoulder strap that is used to connect the backpack to an operator; the front panel further additionally reversibly attaches to the back panel by a plurality of connection straps;

(B) a folding chair that moves from an unfolded position that allows a person to sit in the folding chair to a folded position for storage, the folding chair being in the folded position;

wherein when the first fastener is closed, the chair compartment encloses the set of connection straps; and wherein the folded folding chair is placed between the front panel and back panel to be sandwiched between the front panel and back panel so that one or more edges of folding chair that protrude outward from between the two panels, a set of connection straps removably connects the folding chair to the backpack between front panel and back panel.

12. The combination of claim 11 wherein one edge of the folded folding chair rests upon the common edge.

13. The combination of claim 11 wherein the set of connection straps are adjustable in length to allow the connection straps to respectively go around the side edges of the folded folding chair to hold the folded folding chair to the backpack.

14. The backpack folded chair combination of claim 11 wherein one side edge of the folded folding chair protrudes out beyond the top edge of the front panel.

15. The backpack folded chair combination of claim 11 wherein one side edge of the folded folding chair protrudes out beyond the right edge of the front panel.

16. The backpack folded chair combination of claim 11 wherein one side edge of the folded folding chair protrudes out beyond the left edge of the front panel.

17. A process for operating backpack that is used to carry a folded folding chair, the process comprising the following steps, but not necessarily in the order shown:

(A) providing a folding chair that moves from an unfolded position that allows a person to sit in the folding chair to a folded position for compact storage, the folding chair being in the folded position;

(B) providing a backpack having a front panel that hingedly connects by a common edge to a back panel and also removably connects to the back panel via a first fastener in order to form a chair compartment, the front panel further supporting at least one shoulder strap that is used to connect the backpack to an operator; the front panel further removably attaches to the back panel by a set of connection straps which are capable of being enclosed within the chair compartment when said first fastener is closed;

(C) placing the folded folding chair between the front panel and the back panel so that the folded folding chair rests upon the common edge to be sandwiched between the front and back panels, one or more portions of the folded folding chair extending past one or more of the edges of the front panels; and (D) engaging the set of connection straps to hold the folded folding chair between the front panel and the back panel.

18. The process of claim 17 wherein the engaging the set of connection straps further comprising a step of adjusting the respective lengths of the connection straps to allow the connection straps to go around one or more edges of the folded folding chair as the one or more edges of the folded folding chair protrude beyond the front panel.

19. The process of claim 17 further comprising a step of disconnecting the set of connection straps from the back panel to remove the folded folding chair from between the front panel and the back panel.

20. The process of claim 19 further comprising a step of forming a chair compartment to enclose the set of connection straps within the chair compartment.

* * * * *